US009132431B2

(12) United States Patent
Alderson et al.

(10) Patent No.: US 9,132,431 B2
(45) Date of Patent: Sep. 15, 2015

(54) EQUIPMENT FOR USE IN THE EXTRACTION OF PLACER GOLD FROM GRAVEL AND SAND DEPOSITS

(75) Inventors: Larry Allen Alderson, Robards, KY (US); Peggy I. Alderson, Robards, KY (US)

(73) Assignee: Larry Allen Alderson, Robards, KY (US)

( * ) Notice: Subject to any disclaimer, the term of this patent is extended or adjusted under 35 U.S.C. 154(b) by 494 days.

(21) Appl. No.: 12/657,265

(22) Filed: Jan. 15, 2010

(65) Prior Publication Data

US 2010/0193406 A1 Aug. 5, 2010

Related U.S. Application Data

(60) Provisional application No. 61/206,728, filed on Feb. 4, 2009.

(51) Int. Cl.
*B03B 7/00* (2006.01)
*B03B 5/26* (2006.01)
*B03B 9/00* (2006.01)

(52) U.S. Cl.
CPC .... *B03B 5/26* (2013.01); *B03B 9/00* (2013.01)

(58) Field of Classification Search
USPC ..... 209/44
IPC ..... B03B 5/26,9/00
See application file for complete search history.

(56) References Cited

U.S. PATENT DOCUMENTS 801,968 A * 10/1905 Clark ..... 209/44
883,861 A * 4/1908 Creasey ..... 209/44
1,240,396 A * 9/1917 Winchester ..... 209/43
1,473,039 A * 11/1923 Harkins ..... 209/440
1,510,742 A * 10/1924 Gutleben ..... 209/420
1,915,602 A * 6/1933 Goody ..... 209/273
1,973,770 A * 9/1934 McCullough ..... 209/14
2,101,295 A * 12/1937 Rusk ..... 209/466
2,174,925 A * 10/1939 McKeever ..... 209/44
2,261,574 A * 11/1941 Thompson ..... 209/202
2,358,409 A * 9/1944 Martin ..... 209/451

(Continued)

*Primary Examiner* — Stefanos Karmis
*Assistant Examiner* — Michael E Butler

(57) ABSTRACT

A portable device for the separation of gold from other materials commonly found in placer deposits of gravel, sand, etc. Including an upper tray (72) into which is located a water spray assembly and placer materials classifier. This upper tray to be hinged to middle sluice tray (98), which has located on its bottom panel an expanded metal section (38) on top of a final mat (40) consisting of ribbed rubber matting or other suitable material, which has a series of groves, to be used as washable riffling device. Lower sluice tray (96) to be attached by hinging device to middle sluice tray (98) and locked into place by lower tray locks (48). Lower sluice tray to have laying on its bottom panel a continuation of final mat (40). This mat to be held in place by a riffle cage (36) containing a series of rigid riffles. Riffle cage (36) to be secured by hold down clamps (64). Expanded metal to be held in place by tab (42). Upper tray to be supported by sliding brace (43) and locking handles (94). Device to be supported by legs (68) and extenders (74). Water to be supplied by small pump to device through flexible hose connected to feed pipe (78). When not in use the device to be folded and compactable into small portable unit with storage of legs, mat, riffle cage and other removable accessories inside embodiment and secured by means of storage lids (30) and (90). Lid (90) to be secured by means of locks (48) and tabs (114). Device to be carried by handle (88).

14 Claims, 17 Drawing Sheets

(56) References Cited

U.S. PATENT DOCUMENTS

| | | | | | |
|---|---|---|---|---|---|
| 2,362,706 | A | * | 11/1944 | Macartney | 209/196 |
| 3,642,129 | A | * | 2/1972 | McDaniel et al. | 209/159 |
| 3,910,837 | A | * | 10/1975 | Good | 209/461 |
| 4,082,657 | A | * | 4/1978 | Gage | 209/311 |
| 4,101,419 | A | * | 7/1978 | Bergman | 209/13 |
| 4,178,238 | A | * | 12/1979 | Harris | 209/270 |
| 4,199,441 | A | * | 4/1980 | Ross | 209/44 |
| 4,253,943 | A | * | 3/1981 | Thrasher | 209/44 |
| 4,319,985 | A | * | 3/1982 | Hibbard | 209/3 |
| 4,339,043 | A | * | 7/1982 | Tice et al. | 209/44 |
| 4,359,383 | A | * | 11/1982 | Sweet | 209/479 |
| 4,360,424 | A | * | 11/1982 | Pearson et al. | 209/44 |
| 4,371,435 | A | * | 2/1983 | Eckersley | 209/44 |
| 4,389,309 | A | * | 6/1983 | Konvalin | 209/465 |
| 4,543,178 | A | * | 9/1985 | Goldstein | 209/2 |
| 4,592,833 | A | * | 6/1986 | Perdue | 209/44 |
| 4,642,180 | A | * | 2/1987 | Kaufman | 209/44 |
| 4,962,858 | A | * | 10/1990 | Newman et al. | 209/44 |
| 5,033,332 | A | * | 7/1991 | Riley | 266/249 |
| 5,287,975 | A | * | 2/1994 | Chumley et al. | 209/3 |
| 5,896,997 | A | * | 4/1999 | Tanner | 209/269 |
| 5,927,509 | A | * | 7/1999 | Lord | 209/44 |
| 6,138,833 | A | * | 10/2000 | Matsufuji et al. | 209/10 |
| 2004/0113482 | A1 | * | 6/2004 | Weholt | 299/17 |
| 2007/0071557 | A1 | * | 3/2007 | Benjamin et al. | 405/128.15 |

* cited by examiner

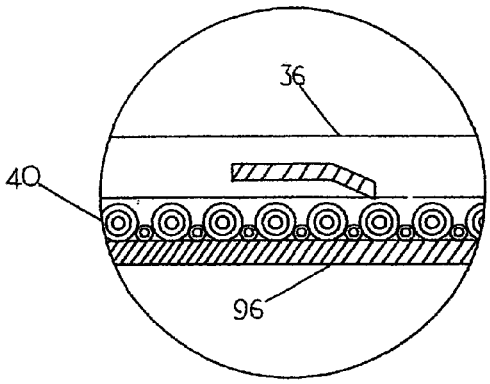
FIG. 19-A
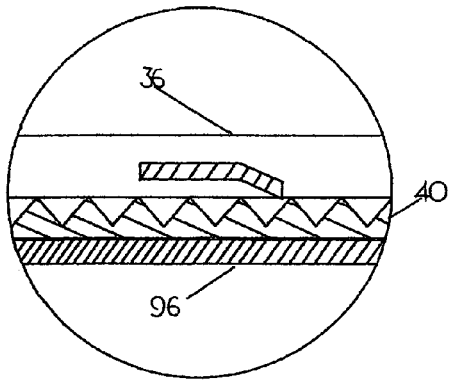
FIG. 19-B

EQUIPMENT FOR USE IN THE EXTRACTION OF PLACER GOLD FROM GRAVEL AND SAND DEPOSITS

REFERENCE TO RELATED APPLICATIONS

This application claims the benefit of provisional patent application No. 61/206,728 filed Feb. 4, 2009 by the present inventors.

FEDERALLY SPONSORED RESEARCH

Not Applicable

SEQUENCE LISTING OR PROGRAM

Not Applicable

BACKGROUND

1. Field

This application relates to the mining of precious metals, in particular gold.

2. Prior Art

Gold prospectors and miners typically travel to remote locations to locate rich deposits of gold bearing placer deposits. To reach these Locations requires a tremendous amount of effort on the part of the prospector. The prospector is usually limited in the amount of equipage that he is able to transport. With the exception of the basic gold pan, all the equipment traditionally needed to process these placer deposits has been extremely heavy and bulky. While a basic gold pan is very efficient, it is not able to process a very large amount of gold bearing sands and gravel. Therefore, the tool of choice to accomplish a reasonable rate of recovery has been the gold sluice or some variation of it. Efforts have been made in the past to reduce the physical requirements needed to transport the needed sluice or its variation, usually at the forfeit of usability or function. U.S. Pat. No. Des. 377,182 issued Jan. 7, 1997 to Simpson, shows a basic sluice. While small and functional it is not very versatile, requiring a flowing natural water source in order to function. Its reduced size also limits the amount of raw material it is able to process. A larger more efficient transportable sluice is shown in U.S. Pat. No. 3,799,415 issued Mar. 26, 1974 to Tidd. While greatly more efficient, its size and carrying method require too much effort to transport. Another piece of equipment favored by prospectors is an enhanced version of the sluice commonly called a high banker. It derives its name by the fact that it can be used out and away from the stream flow. This does make it much more versatile than a basic sluice but is again more difficult to transport. In order to function it requires a source of pressurized water. This source is usually obtained by using a gas or electric pump with its intake source a stream or an area of ponded water. U.S. Pat. No. 7,012,209 B2, issued Mar. 14, 2006 to Loewen, shows an apparatus using this method. Transportation by manual methods is extremely cumbersome and not very desirable. U.S. Pat. No. 4,525,270 issued Jun. 25, 1985 to McCann, depicts an interesting apparatus but due to its small size and cumbersome handling and transporting characteristics leaves much to be desired by the prospector. Having to empty and clean the filter bag system is a further interference to efficiency. U.S. Pat. No. 4,319,985 issued Mar. 16, 1982 to Hibbard, is a more efficient system but is lacking the portability desired by the prospector. All the aforementioned devices also lacks the flexibility needed to have a diverse, fully functional piece of prospecting equipment.

They lack the ability to process placer gravel and sand by more than one method. In addition to the sluice and its variant, previously referred to as a high banker, another piece of prospecting equipment is available commonly referred to as a suction dredge. This apparatus uses water or air forced down a hose to the nozzle under pressure. Its function is to generate a negative pressure in the nozzle whereby in addition to the pressurized air/water stream the negative pressure in the nozzle sucks in through the nozzle tip additional water and a quantity of sand and gravel. These are then carried to a separating device, called a sluice. U.S. Pat. No. 1,653,027, issued Dec. 20, 1927 to Ward, demonstrates this nozzle This nozzle is designed for large commercial mining ventures with no thought to the small prospector. None of the devices referred to have the dual function and ability to accept and process both placer sand and gravel by either a slurry as provided by the suction nozzle system and also manually by hand feeding with a shovel or a variant.

ADVANTAGES

My invention addresses all the shortcomings of the previous designs. Not only is it highly portable it is a fully functional piece of equipment. It has the ability to process placer materials whether manually fed by hand or by a pressurized slurry system.

SUMMARY OF THE INVENTION

This application is for a lightweight, compact piece of mining equipment that allows the prospector great flexibility and portability while still providing excellent heavy metals and minerals recovery. It is a gold concentrator that removes gold from suspension, utilizing a slurry of sand and water provided by several means. While gold concentrators of different designs have been in circulation for many years they have tended to be rather large, bulky and hard to transport. With this in mind the object of this embodiment has been to provide the prospector with a very compact piece of mining equipment that is also very light and easy to set up without sacrificing any features of much larger units. To optimize recovery of the gold particles, gold bearing placer materials are introduced into the upper portion of the invention where they are mixed with water thereby creating a slurry. The slurry passes through a removable, interchangeable classifier, thereby removing larger waste rock and gravel. The slurry then falls upon a deflector pan or under chute which carries it by means of gravity, and its liquid state, to the upper portion of the processing sluice or tray. The sluice area is composed of bi-fold trays that hinge on each other whereby its overall length can be reduced for transportation and expanded for use. With this arrangement no sacrifice of recovery area is made. If the embodiment is used in conventional mode then a small pump, gas or low voltage electric, is placed in a water supply. This water supply may be a natural body of water or a containment vessel. With this in mind, my embodiment is small enough to be placed within a small storage, transportation container. This storage container can then be used as a recirculating water containment vessel. This ability is of great benefit to prospectors working in arid areas where a natural water source is not available. Water, either from a natural or artificial source is pumped, by means of a small flexible hose, to the spray piping arrangement located in the upper tray portion of the invention. This spray piping system is constructed so that water under pressure, provided by the pump is sprayed, out across the sand and gravel placer materials, through a plurality of small holes directed at the placer materials receiving area on top of the classifier, thereby creating the aforementioned slurry. The waste material then slides off the lower end of the classifier and is no longer an area of concern. After being diverted to the upper end of the lower sluice area the slurry then passes over the expanded metal section. This section consist of raised expanded metal which in cross section creates a series of small riffles. The purpose of a riffle is to create an area of low pressure, located immediately behind the riffle, into which gold particles as well as other heavy materials, mostly hematite and magnetite, commonly referred to as black sand, become trapped. Some heavier gemstones are also collected in the low pressure areas commonly referred to as eddies. Eddies are created when a protrusion is placed into a moving flow of water, creating high pressure on the upstream side and low pressure on the down stream side. The aforementioned expanded metal section is placed on top of a final mat consisting of any number of materials. The most common are ribbed indoor outdoor carpet, v-ribbed rubber matting or an extruded rubber fiber matting commonly referred to as "miners moss". The purpose of the final mat is to provide additional small riffles by means of a series of small groves which run perpendicular to the flow of the slurry. After leaving the expanded metal section the slurry then passes over a riffle cage consisting of a plurality of riffles which run perpendicular to the slurry flow. Again, the riffle cage is installed on top of the final mat and secured in place. Since the recovery rate of the invention is dependant on water flow the utilization of adjustable legs is provided. This allows for maximum adjustment of the water flow which must be carefully regulated for maximum recovery. In lieu of a spray bar method of creating the slurry, an adapter mechanism is provided for the use of an underwater dredge system. This system sucks raw material from the bottom of the prospecting body of water carrying with it the placer materials containing the black sand and gold particles and sprays it across the upper tray classifier

DRAWINGS-FIGURES

Dwg. 1/17 FIG. 1 Shows the embodiment in its storage/transportation configuration.

FIG. 2 Shows the embodiment set up and ready to use.

Dwg. 2/17 FIG. 3 Shows the embodiment in use by being manually fed with placer sand/gravel. Water is supplied from a natural water source near the embodiment.

Dwg. 3/17 FIG. 4 Shows the embodiment in use by being fed with a sand/gravel slurry by means of an underwater dredge system.

Dwg. 4/17 FIG. 5 Shows one of two storage/transportation lids used by the embodiment.

Dwg. 5/17 FIG. 6 Shows the embodiment in an exploded view illustrating some of the major components.

Dwg. 6/17 FIG. 7 Shows a portion of the embodiment, referred to as the middle tray, and all of its components.

Dwg. 7/17 FIG. 8 Shows the embodiment in top or plan view. Also depicted are some of the components and their positions on the embodiment.

Dwg. 8/17 FIG. 9 Shows a section view derived from the plan view in FIG. 8 on Dwg. 7/17. Also shown are some parts and their positions on the embodiment including reference to FIG. 19-A and FIG. 19-B.

Dwg. 9/17 FIG. 10 Shows the riffle cage and components

Dwg. 10/17 FIG. 11 Shows the embodiment in use by being fed manually with placer sand and gravel. Water is supplied by a recirculating method utilizing a transportation container.

Dwg. 11/17 FIG. 12 Shows the embodiment in travel/storage position.

Figure 15:
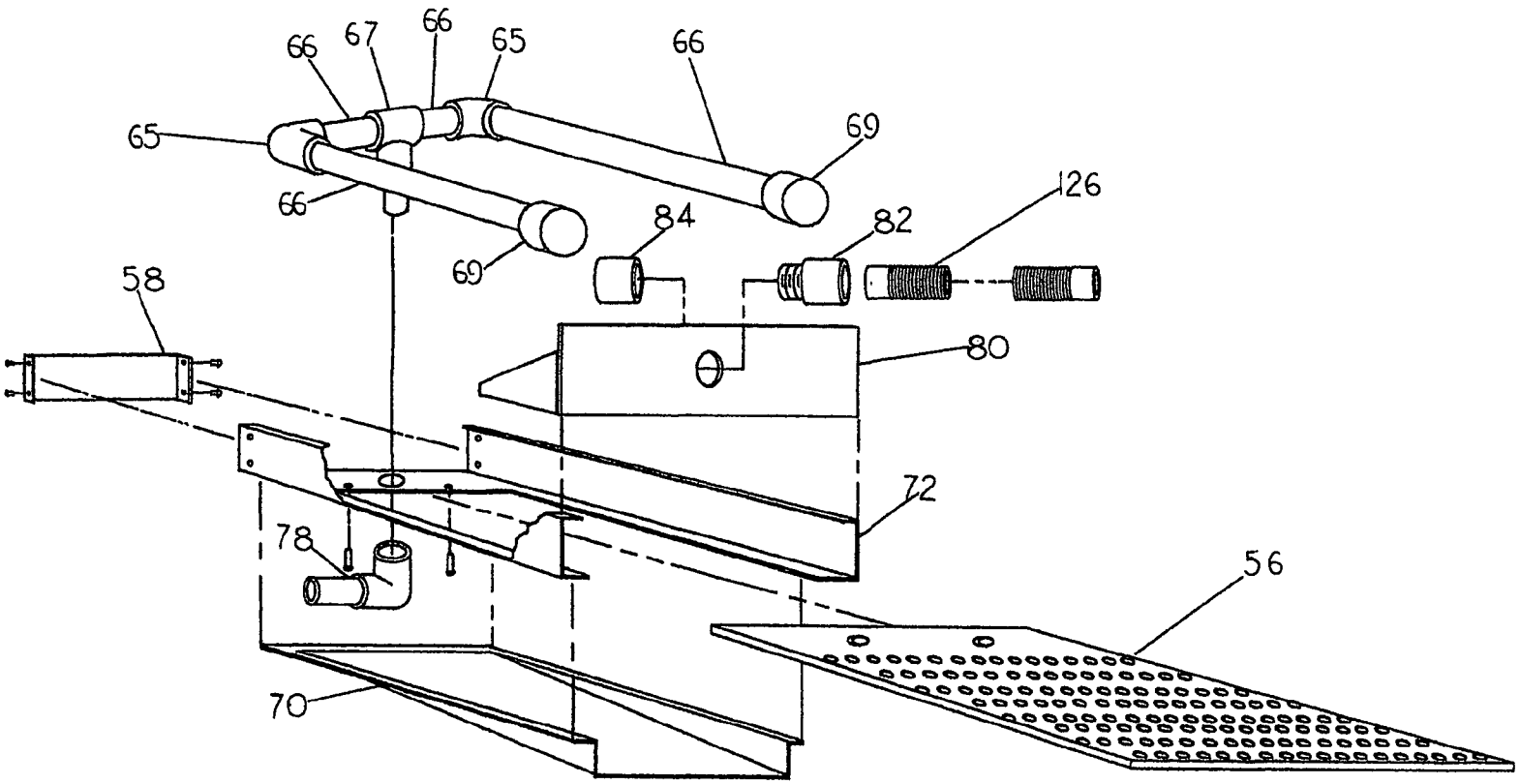

Dwg. 12/17 FIG. 15 Shows the upper tray of the embodiment and its components.

Figure 16:
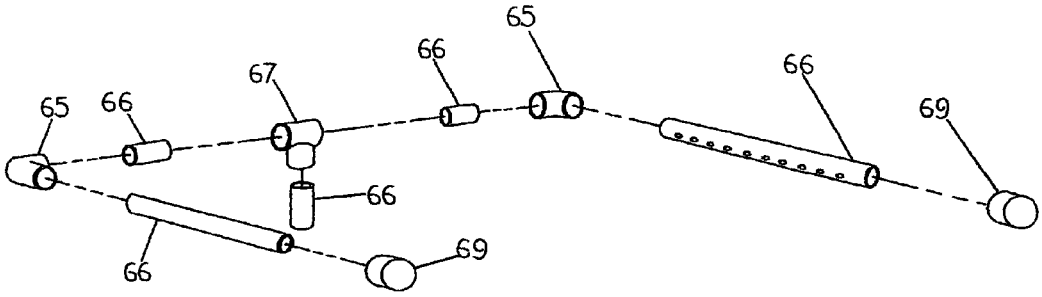

Dwg. 13/17 FIG. 16 Shows the spray bar in exploded view as well as its components.

Figure 17:
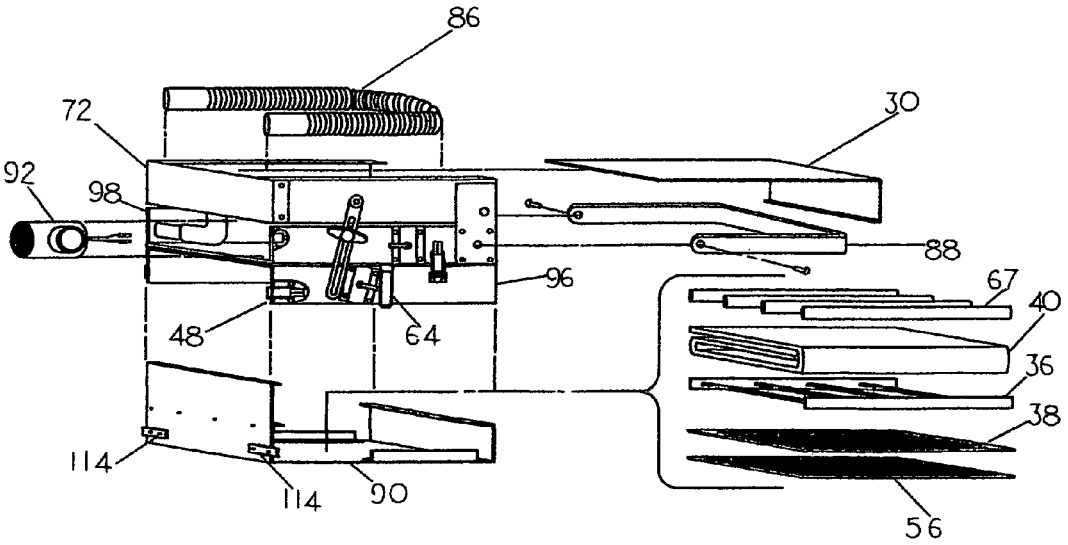

Dwg. 14/17 FIG. 17 Shows the embodiment in storage, travel mode as well as the accessories and their locations.

Figure 18:
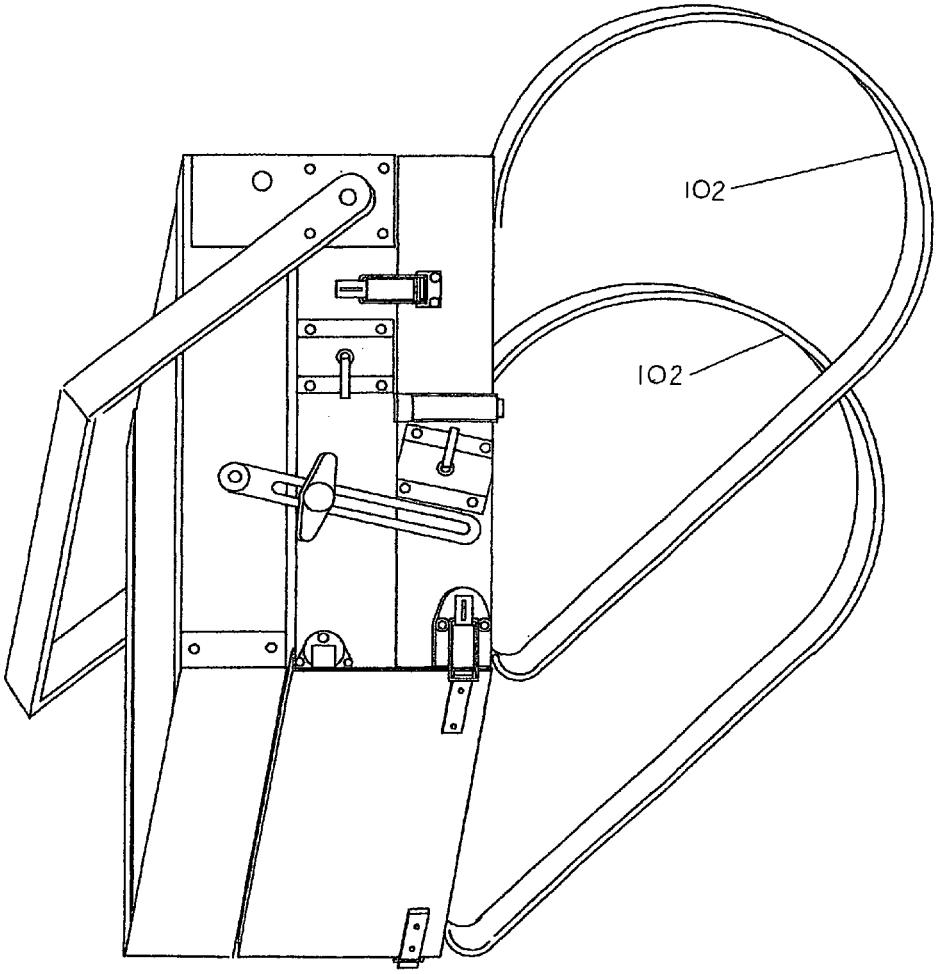

Dwg. 15/17 FIG. 18 Shows the embodiment with optional shoulder straps for backpacking.

Figure 9:
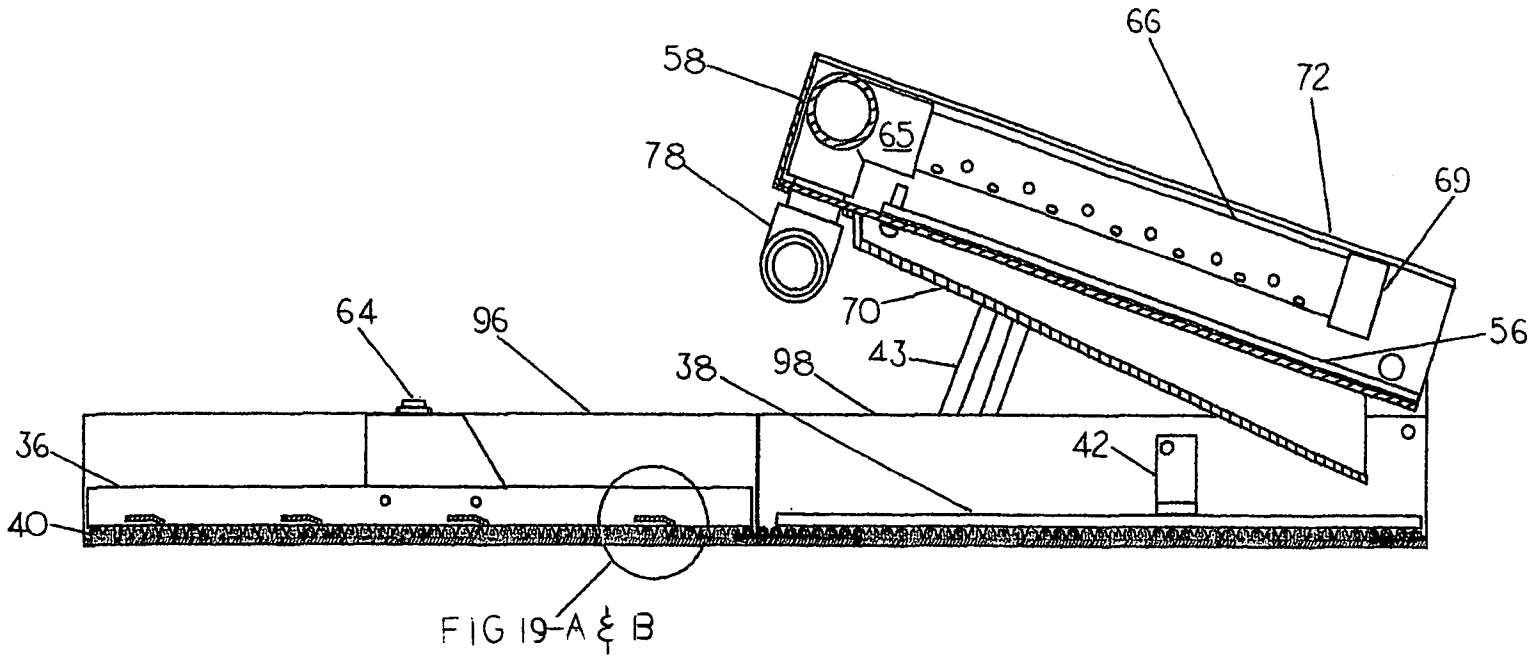
Figure 20:
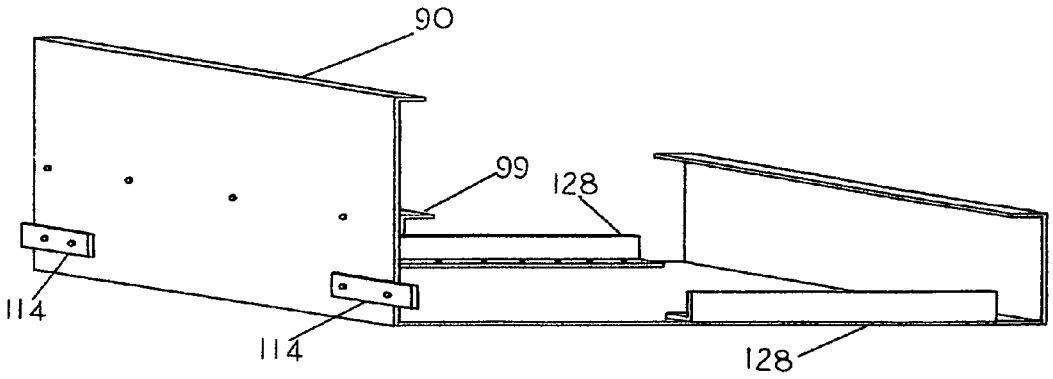

Dwg. 16/17 FIG. 19-A Shows a sectional view derived from FIG. 9 on Dwg. 8/17. This section shows a riffle as well as indoor outdoor carpet being used as a collecting medium FIG. 19-B Shows a sectional view derived from FIG. 9 on Dwg. 8/17. This section shows a riffle as well as ribbed rubber matting being used as a collecting medium Dwg. 17/17 FIG. 20 Shows the larger storage lid used in storage/travel mode.

DRAWINGS-REFERENCE NUMERALS

30 Small lid
32 Lid strap
34 Lid strap bracket
36 Riffle cage
38 Expanded metal section
40 Final mat
42 Expanded metal section hold down tab
43 Sliding brace
44 Upper tray pivot bracket
46 Middle tray end plate
48 Lower tray lock
50 Leg socket
52 Closure clasp
54 Lower and middle tray hinge
56 Upper tray classifier
58 Upper tray end plate
60 Leg locking screw
62 Closure tab
64 Riffle hold down clamp
65 90 degree ell.
66 Spray pipe
67 Tee
68 Leg
69 Cap
70 Under chute
72 Upper tray
74 Leg extender
76 Leg extender pin
78 Spray piping feed pipe
80 Upper tray dredge feed plate
82 Dredge discharge hose adapter
84 Dredge pipe adapter lock ring
86 Spray piping feed hose
88 Carry handle
90 Storage lid
92 Low voltage pump
94 Sliding brace locking handle
96 Lower tray
98 Middle tray
99 Retaining lip
100 Riffle cage hold down tab

Figure 1:
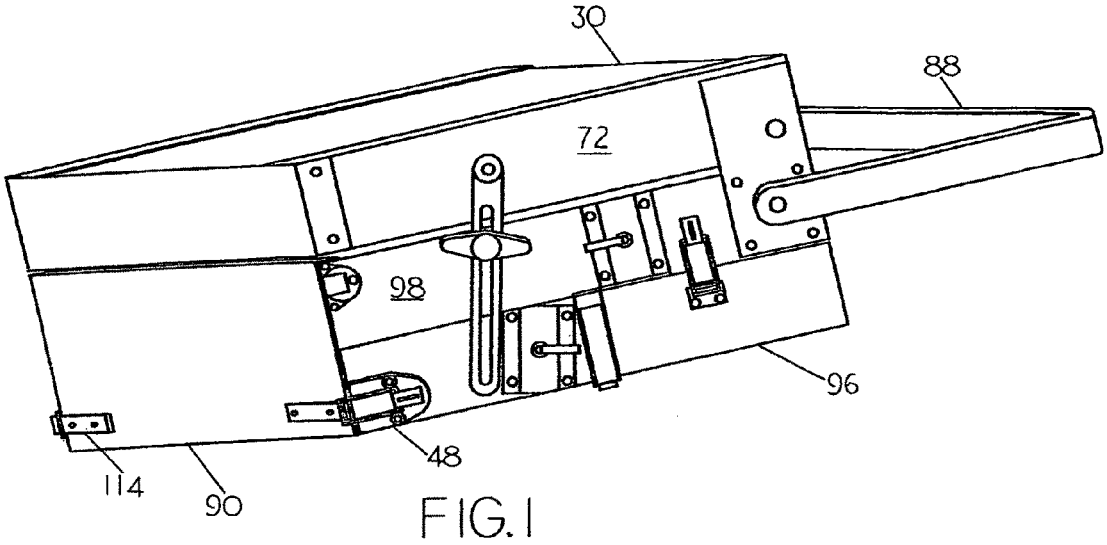

102 Shoulder straps
104 Storage container
106 Water level
108 Gravel waste tailings
110 Sand/gravel placer materials
112 Water/sand slurry
114 Latching tabs
116 Intake screen
118 Intake hose
120 Pressure pump
122 Pressure hose
124 Dredge suction nozzle
126 Dredge discharge hose
128 Retaining rail Detailed Description FIG. 1

FIG. 1 of the embodiment, as shown on Dwg. 1/17, shows the embodiment in its carrying/storage configuration. All accessories have been stowed inside, and covers in place. The prospector is now ready to pick up the embodiment and transport or store the equipment.

Figure 2:
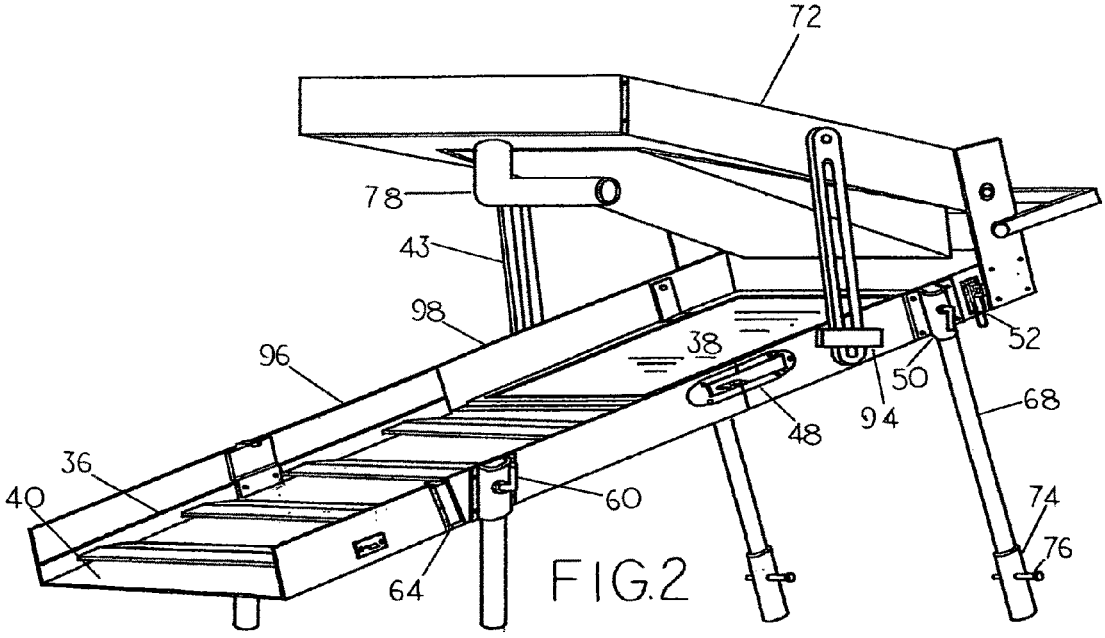

Detailed Description FIG. 2

FIG. 2 of the embodiment, as shown on Dwg. 1/17 shows the embodiment in a configuration for use with the exception of the water source, which is not shown.

Figure 3:
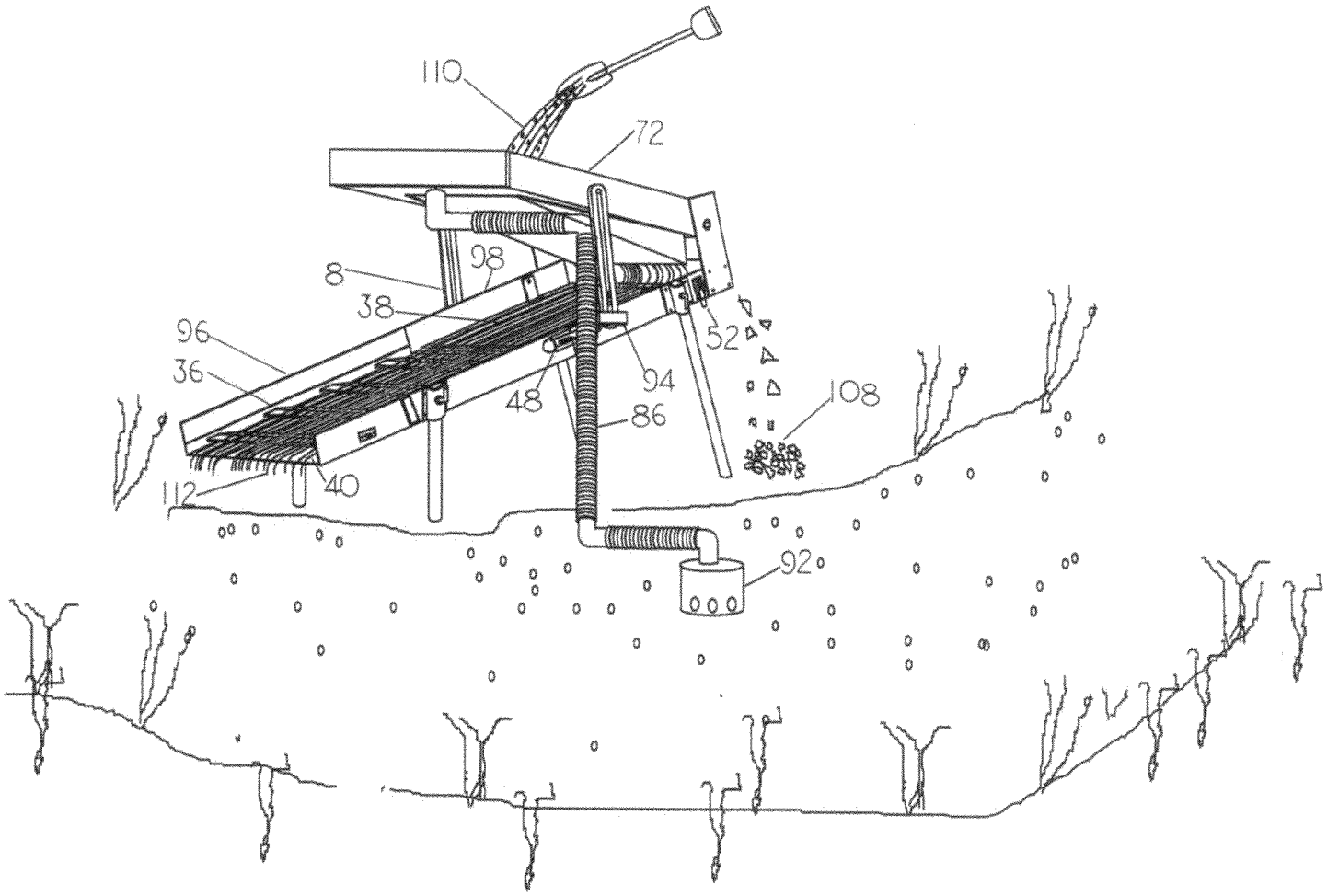

Detailed Description FIG. 3

FIG. 3 as shown on DWG. 2/17 shows the embodiment set up and ready for general use. Upper tray 72 has been raised and sliding braces 8 have been locked in place by sliding brace lock handle 94. Lower tray 96 has been released from closure clasp 52 and rotated and locked in position by the lower tray lock 48. Final mat 40 is in place as are expanded metal section 38 and riffle cage 36. Sand/gravel placer materials 110 are being manually fed into the upper tray 72. They are being processed by water supplied, through the spray piping hose 86, by a pump 92 in a natural source of water. Water/sand slurry 112 with gold/gem values are being carried through and down the recovery area consisting of the middle tray 98, lower tray 96, expanded metal section 38, riffle cage 36, and final mat 40. Gravel waste tailings 108 are shown coming off the upper tray 72

Figure 4:
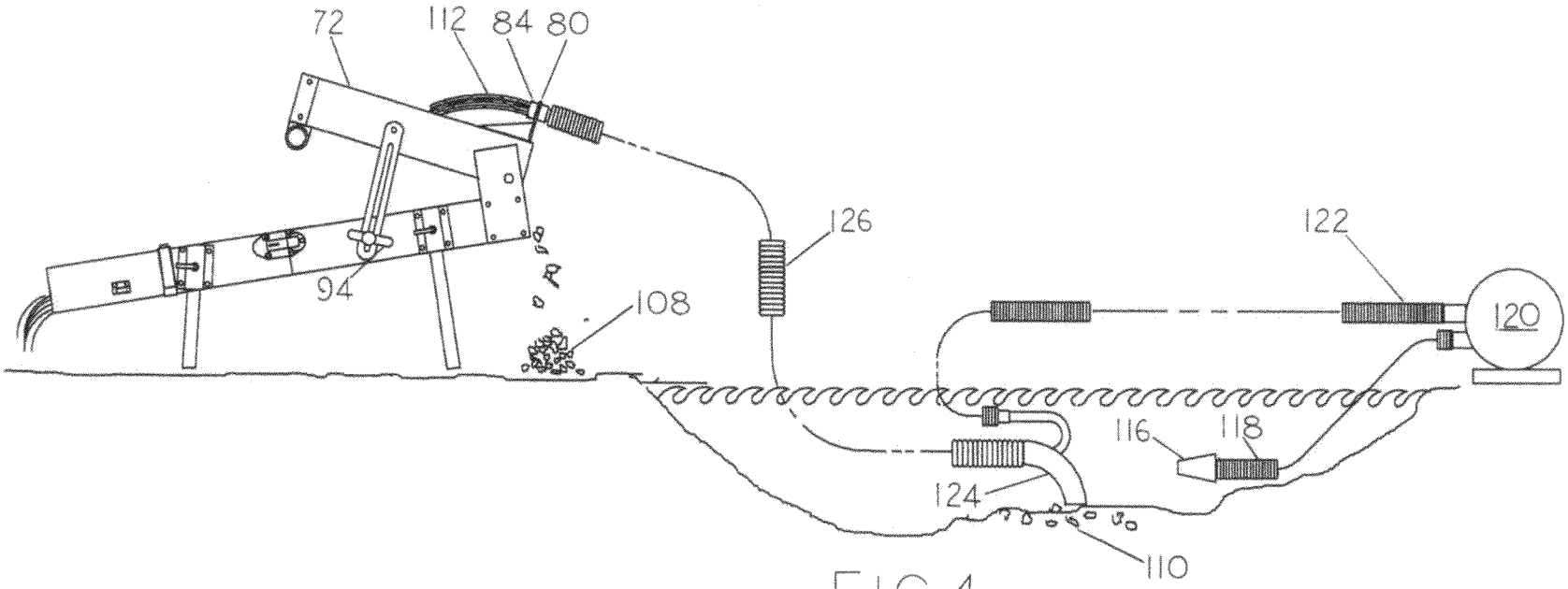

Detailed Description FIG. 4

FIG. 4 as shown on Dwg. 3/17 shows one method of using the embodiment. It involves the use of dredge suction nozzle 124 in the processing of sand/gravel placer materials 110. In order for this system to work an external source of pressurized water is required. Pressure pump 120, which is a hand transportable small horsepower water pump fulfills this need. It provides pressurized water to the suction nozzle 124 by means of a small diameter flexible pressure hose 122.

This water is supplied to the pump through intake screen 116 and intake hose 118. These have been positioned in a natural body of water. In this instance the same body of water that contains the sand/gravel placer materials 110. Since the suction nozzle 124 is constructed to handle a larger capacity of water than the pump 120 and pressure hose 122 are providing and also since this water is under pressure, it creates a negative vacuum inside the nozzle. Because of this vacuum the prospector is able to introduce the tip of the nozzle into the placer sand and gravel and generate a sand/gravel slurry 112 which is forced up the discharge hose 126. This sand/gravel slurry 112 is then discharged into the upper tray 72 for processing. The dredge discharge hose 126 is attached to the lower end of the upper tray 72 by means of a removable upper tray dredge feed plate 80, dredge discharge hose adapter 82 and dredge discharge hose adapter lock ring 84. The sand/gravel placer materials 110 are processed in the normal manner. The gravel waste tailings 108 are discharged from the rear of the upper tray 72 and the water/sand slurry 112 are processed through the lower sluice area consisting of the middle tray 98, lower tray 96, expanded metal section 38, riffle cage 36 and final mat 40 as shown in FIG. 3. Use of the spray piping assembly is not utilized when the embodiment is used in suction dredge mode.

With the exception of the use of my embodiment in the separation of the sand and gravel from the gold particles in liquid suspension, this mode of operation is to be considered Prior Art. This is based on U.S. Pat. No. 1,653,027 to Ward dated Dec. 20, 1927.

Figure 5:
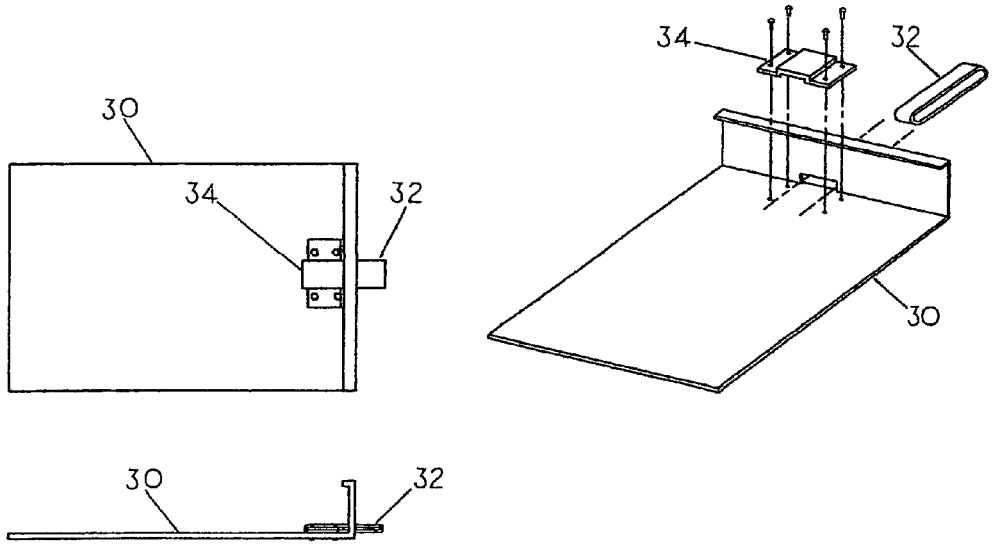

Detailed Description FIG. 5

FIG. 5 on Dwg. 4/17 shows the small lid 30 and its attached components, lid strap 32 and lid strap bracket 34. The purpose of this lid is to provide a convenient cover and retaining mechanism whereby loose accessories, in particular the spray piping hose 86, are stored while in storage transportation configuration.

Figure 6:
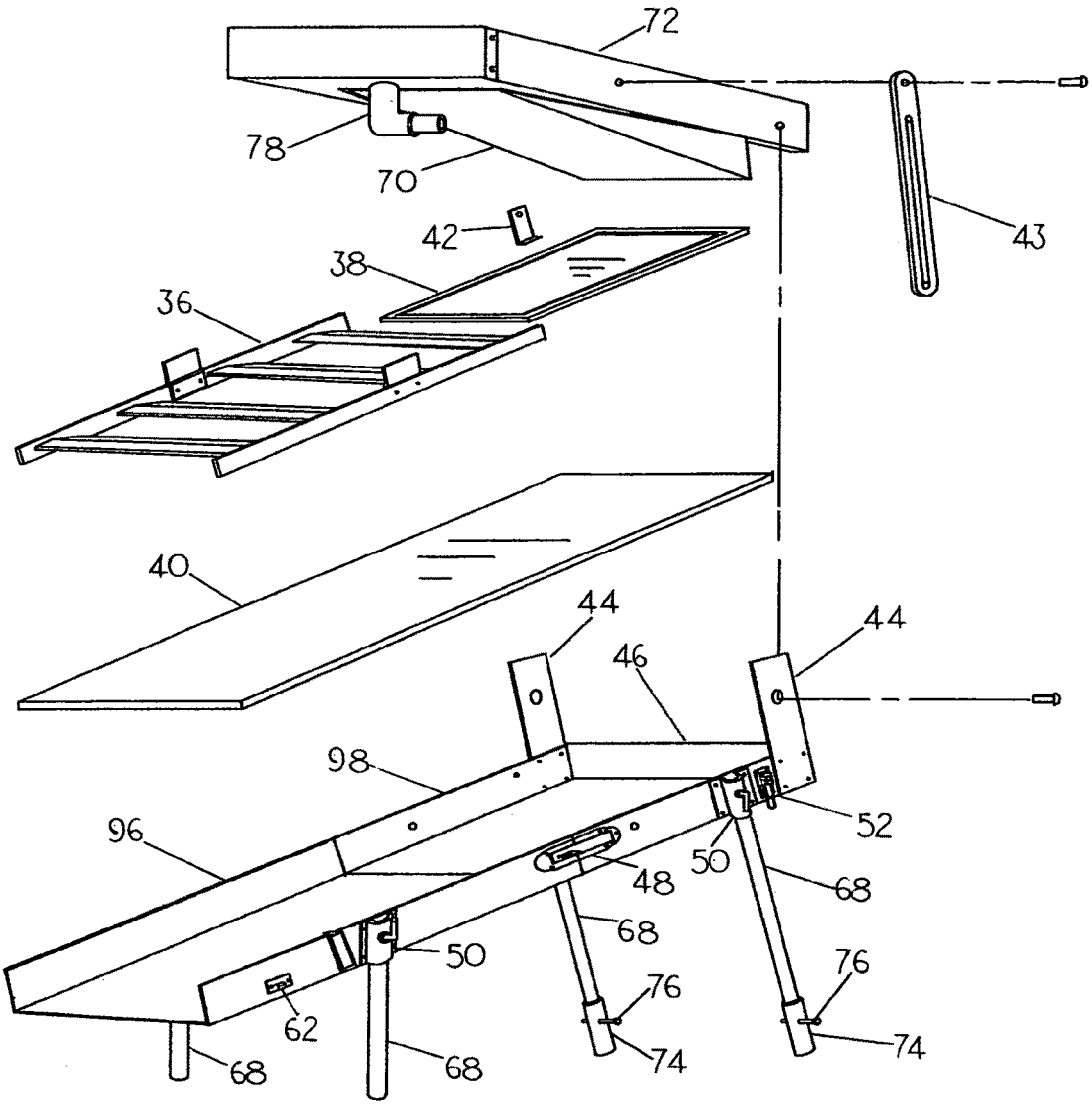

Detailed Description FIG. 6

FIG. 6 shows some components to make up the embodiment. This is accomplished in exploded or expanded view for clarity. Lower tray 96 has been released from its closure clasp 52 and rotated into position for use. Lower tray locks 48 have been engaged securing lower tray 96 to middle tray 98. Legs 68 are installed into leg sockets 50. Leg extenders 74 have been installed on rear legs 68 and leg extender pin 76 has been inserted. A retaining cable or chain, not shown, is used to keep the retainer pin attached to the leg extender, to prevent loss. Final mat 40 is ready for installation into lower tray 96 and middle Tray 98. This is followed by the expanded metal section 38 which is installed into middle tray 98 and secured by hold down tab 42. Riffle cage 36 is then installed into the lower tray 96 and held in place by riffle cage hold down clamps 64. Upper tray 72 is raised into an inclined position and held in place by sliding brace 43. Raising upper tray 72 exposes spray piping feed pipe 78 which is now ready for connection to a water supply source. Some components are used in plurality as detailed in successive Figures.

Figure 7:
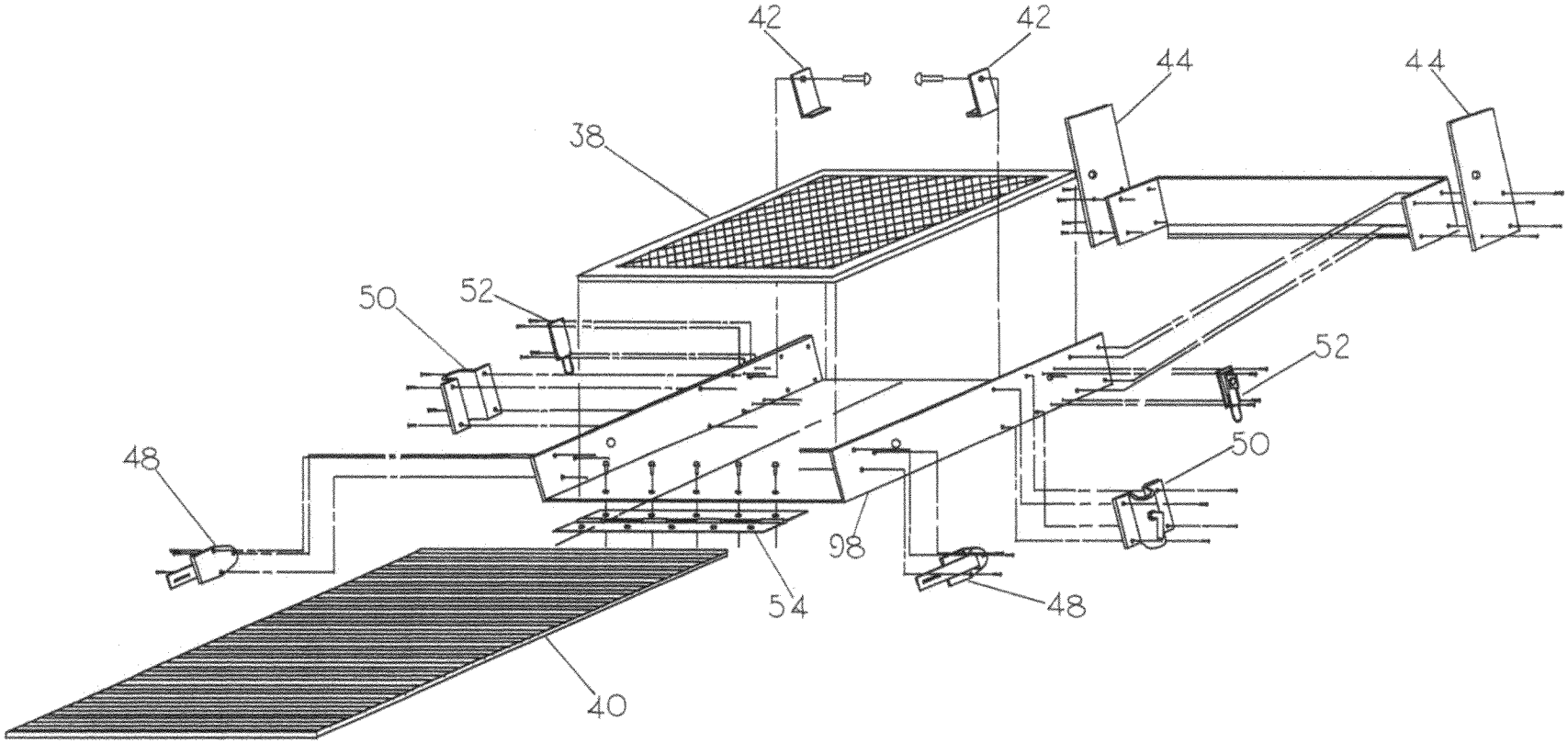

Detailed Description FIG. 7

FIG. 7 Dwg. 6 illustrates middle tray 98 and its components. Middle tray end plate 46 and upper tray pivot brackets are attached to middle tray 98 by means of a plurality of fasteners through a plurality of holes on common centers thereby providing a secure support for upper tray 72, not shown. Lower tray locks 48, leg sockets 50 and closure clasp 52 are all attached to middle tray 98 in positions indicated. Lower tray 96, not shown, is provided by a means of pivot by lower and middle tray hinge 54. These attachments are accomplished by use of fasteners inserted through the attachments and holes provided in the middle tray 98. Also shown in this view is a portion of final mat 40 ready for installing into the bottom of middle tray 98 followed by the expanded metal 38. The expanded metal 38 is secured in place by expanded metal hold down tabs 42, which are provided a single off center fastener, thereby providing a pivot point enabling it to rotate and lock the expanded metal section 38 and final mat 40 in place. Expanded metal section 38 and final mat 40 are placed one on top of the other thereby receiving common pressure from hold down tabs 42. Lower tray locks 48, leg sockets 50, closure clasps 52, upper tray pivot bracket 44 and expanded metal section hold down tabs 42 are common to both sides of middle tray 98.

Figure 8:
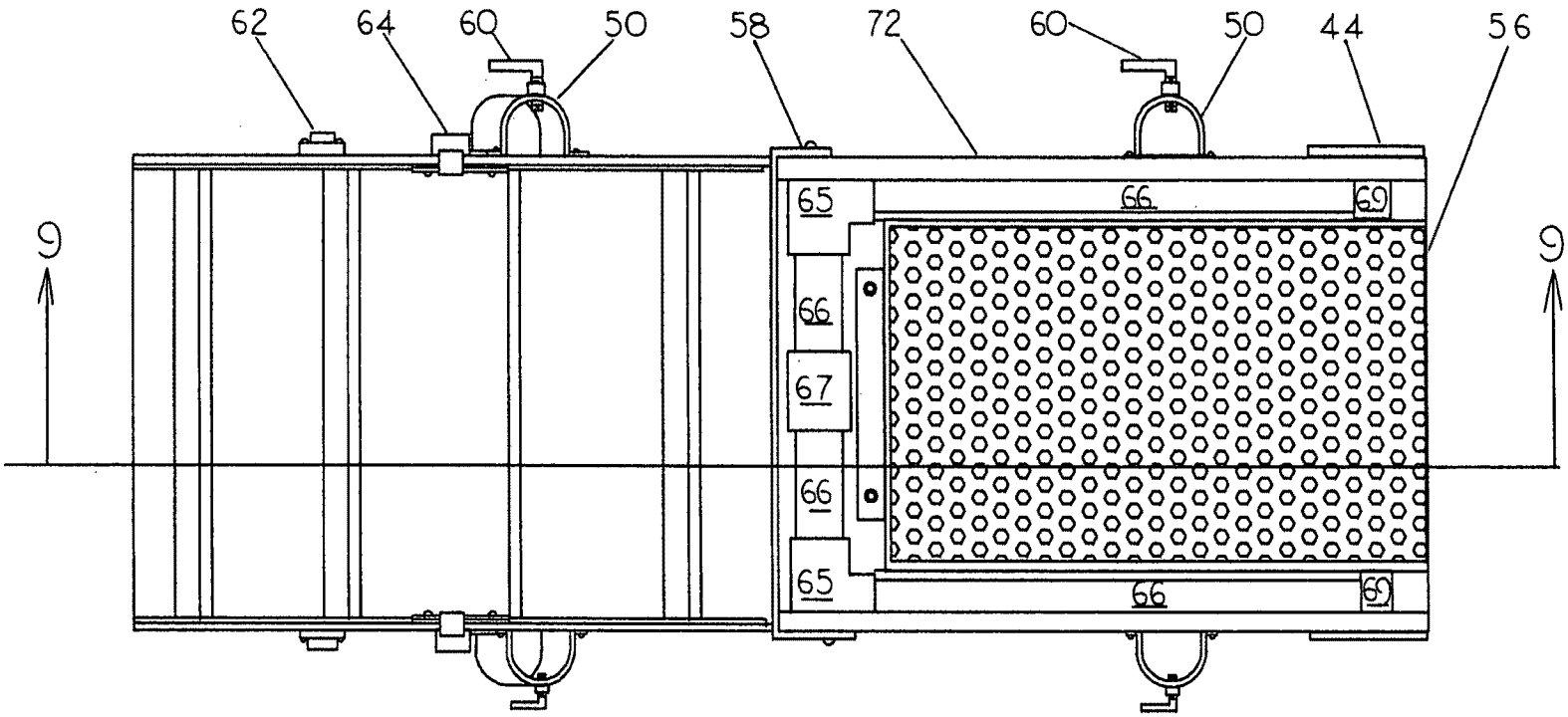

Detailed Description FIG. 8

FIG. 8 shows the embodiment in plan or top view. Closure tabs 62, riffle hold down clamps 64, leg sockets 50, leg locking screws 60 and upper tray pivot brackets 44 are in place. These parts are used in plurality typical to both sides of the embodiment. Also shown is the upper tray 72 with the upper tray end plate 58. The upper classifier 56 is in place as is the spray piping assembly consisting of caps 69, spray pipes 66, tee 67 and 90 degree ells 65. Lastly, shown is a section cut labeled 9 which will be shown on in FIG. 9 Dwg 8/17.

Detailed Description FIG. 9

FIG. 9 Dwg. 8/17 shows section view taken from FIG. 8 Dwg. 7/17. Shown in this section are the lower tray 96, middle tray 98 as well as upper tray 72, which has been raised to an inclined position. The section also shows the riffle cage 36 held in place by riffle cage hold down clamp 64. Expanded metal section 38 is held in place by expanded metal section hold down tab 42. 36 and 38 are placed on top of final mat 40 so that when secured they hold final mat 40 in place. Upper tray 72 is shown in position supported by sliding brace 43. Under chute 70 has been attached with fasteners, not shown, to the bottom of upper tray 72. Upper tray end plate 58 has been attached to upper tray 72. Water spray piping assembly, consisting of spray pipe 66, cap 69, 90 degree ell 65 and tee 67 are in place. Spray piping feed pipe is also in place. Removable classifier 56 is in position over the cut out in upper tray 72. FIG. 19 has been circled, which will show the riffle, and choice of final mat 40.

Detailed Description FIG. 5

FIG. 5 DWG 9/17 shows the embodiment set up for use in recirculating mode. The incline of the upper tray 72 is adjusted by raising and lowering the tray and then tightening sliding brace locking handle 94. A storage container 104 has been positioned below the discharge or lower end of lower tray 96. The interior of the storage container 104 has been filled with water indicated by water level 106. Pump 92 has been positioned in the storage container 92 below water level 104. A section of the side wall of storage container 104 has been removed for clarity. A flexible spray piping hose 86 runs between pump 92 and spray feed pipe 78. Sand/gravel placer material 110 is being loaded into upper tray 72 for processing. Gravel waste tailings 108 are shown being discharged from upper tray 72.

Figure 10:
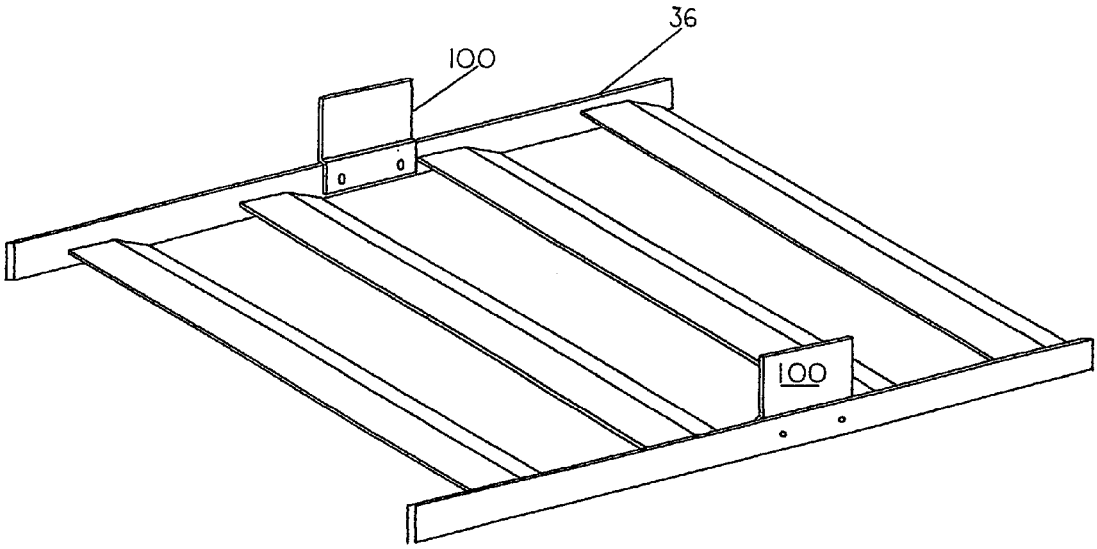

Detailed Description FIG. 10

FIG. 10 Dwg. 9/17 shows riffle cage 36 with both riffle cage hold down tabs 100.

Figure 11:
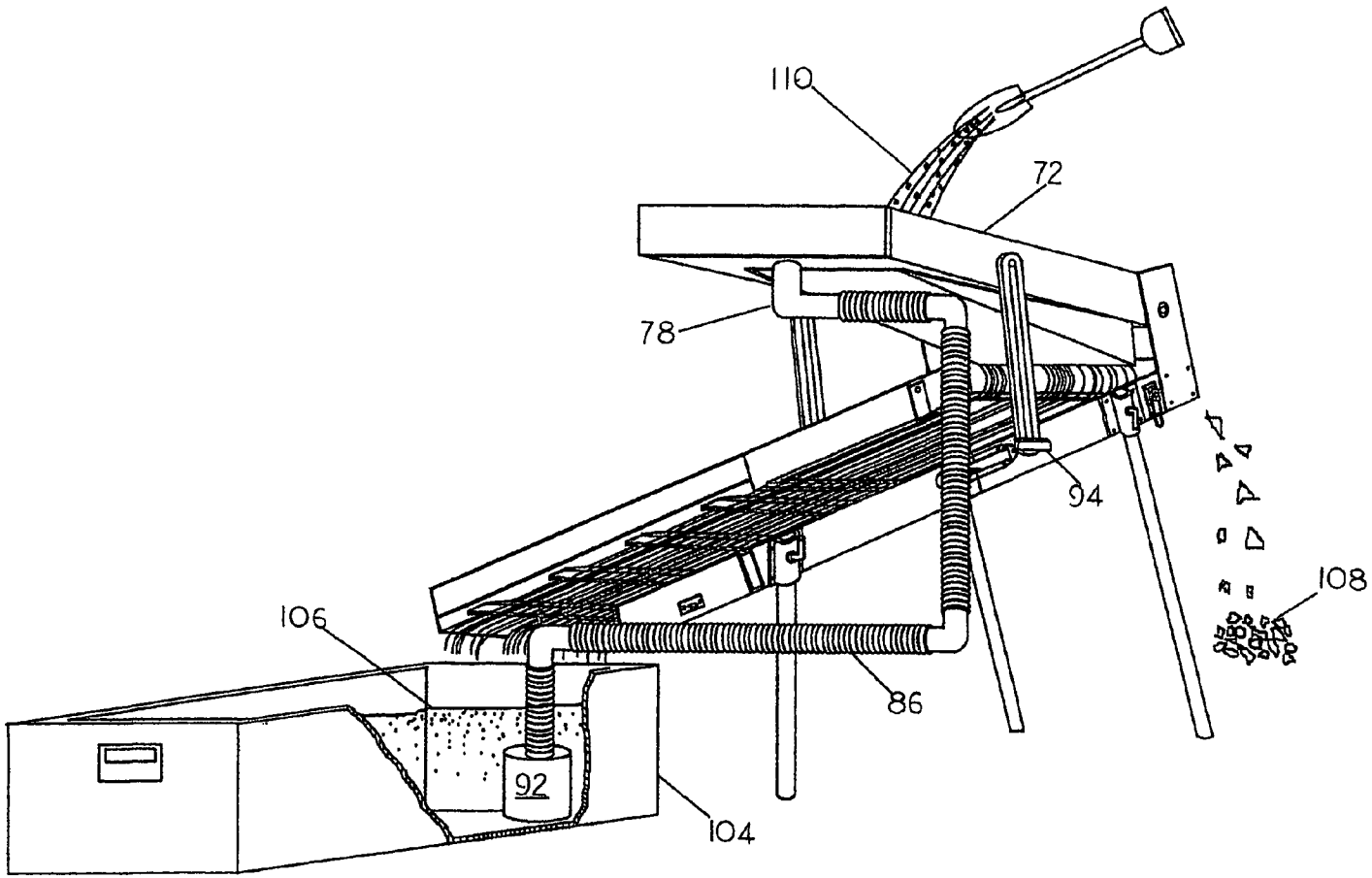

Detailed Description FIG. 11

FIG. 11 Dwg. 10/17 Shows the embodiment in use by being manually fed with placer sand and gravel. Water is supplied by a recirculating method utilizing a transportation container.

Figure 12:
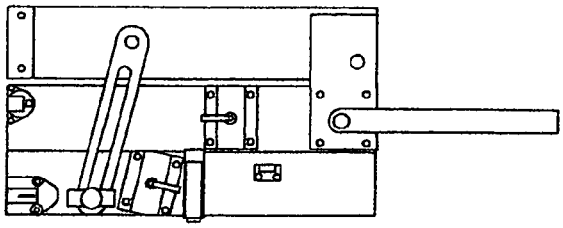

Detailed Description FIG. 12

FIG. 12 DWG. 11/17 Shows the embodiment in storage/travel mode.

Figure 13:
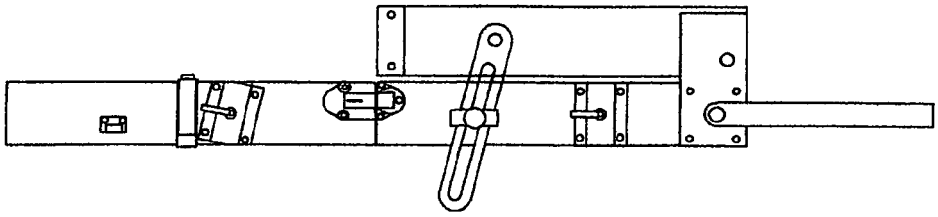
FIG. 13 Shows the embodiment being set up with the lower tray being folded out and secured.

Detailed Description FIG. 13

FIG. 13 DWG. 11/17 shows the embodiment in the process of being set up for operation.

Figure 14:
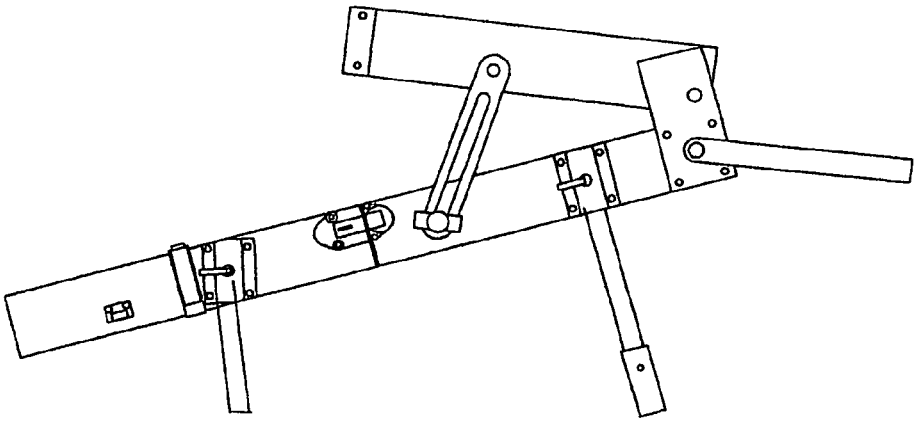
FIG. 14 Shows the embodiment setup complete with the upper tray raised and secured as well as the legs and rear leg extenders in position.

Detailed Description FIG. 14

FIG. 14 DWG. 11/17 shows the embodiment ready for use.

Detailed Description FIG. 15

FIG. 15 DWG 12/17 shows the upper tray 72 and its components. Under chute 70 is permanently attached to the underside of upper tray 72. Upper tray end plate 58 is attached to the upper end of upper tray 72. Spray piping assembly, consisting of spray pipes 66, end caps 69, 90 degree ells 65 and tee 67 are permanently assembled and installed into upper tray 72. Spray feed pipe 78 is installed below and at 90 degrees to the longitudinal line of the upper tray 72. Upper tray 72 is shown with its cut out indicated, over which removable upper classifier 56 is installed. The purpose of the cut out is to allow for passage of the water/sand slurry when placer materials are placed upon upper classifier 56. This slurry passes through the classifier 56 and onto under chute 70 for transfer to the upper end of the middle tray 98, not shown. Shown is removable upper tray dredge plate 80 as well as dredge plate pipe adapter 82 dredge plate adapter lock ring 84 as well as dredge discharge hose 126.

Detailed Description FIG. 16

FIG. 16, DWG. 13/17 shows the spray piping assembly consisting of end caps 69, spray pipes 66, 90 degree ells 65 and tee 67.

Detailed Description FIG. 17

FIG. 17 DWG 14/17 shows the embodiment exploded and expanded to show method of storage of different components. Storage lid 90 is ready to receive legs 21, leg extenders and pins, not shown, final mat 40, which has been folded, riffle cage 36, expanded metal section 38 and upper classifier 56. Pump 92 is positioned in the space between upper tray 72 and middle tray 96. This space is made available when Upper tray 72 is lowered onto middle tray 98. Storage lid 90 it is then placed into position on the embodiment. When this is accomplished lower tray locks 48 engage latching tabs 114. Riffle hold down clamp 64 is also now available to be used to provide addition assistance in keeping storage lid 90 in position. When storage lid 90 is in position, it also provides closure panels for both open ends of lower tray 96, as well as, the one open end of middle tray 98. Spray pipe hose is now coiled and positioned inside the available space in the interior of upper tray 72. Storage lid 30 is then slid into position and the compaction of the embodiment is complete. Carry handle 88 is also shown being held in position by a single fastener on each side of the embodiment thereby providing a pivot point to allow movement of the handle, providing ease of handling.

Detailed Description FIG. 18

FIG. 18, DWG. 15/17 shows the implementation of optional shoulder straps 102. These are to be used as additional carrying points if desired by the prospector.

Detailed Description FIGS. 19-A & 19-B

FIGS. 19-A and 19-B DWG. 16/17 shows enlarged views of a portion of the final mat 40, lower tray 96 and riffle cage 36. The purpose of these views is to demonstrate the purposes of some of the key components. FIG. 19-A shows the use of indoor/outdoor carpet as a final mat 40. FIG. 19-B shows the use of V-grooved rubber matting for a final mat 40. The purpose of these components will be described later.

Detailed Description FIG. 20

FIG. 20, DWG. 17/17 shows the storage lid 90 and its components. These include latching tabs 114, retaining rails 128 and retaining lip 99. The purpose of 114, 128, and 99 are to secure the legs 67, final mat 40, riffle cage 36 3xpanded metal section 38 and upper tray classifier 56. When loaded into storage lid 90 in reverse order it brings into place the legs 67 as being last. By slipping one end of each leg under the formed edge on the shorter end wall of lid 90 and the other end under the storage lip 99 attached to the longer wall of lid 90, it thereby locks all components into position ready for transportation. Also part of this assembly, but not shown, is the use of a lid strap 32 and lid strap bracket 34 similar to that used in FIG. 5, Dwg. 4/17.

Operation

When the embodiment has been set up as shown in FIG. 11, Dwg. 10/17 and being ready to use, gold bearing placer materials are introduced into the upper portion of the embodiment 72 where they are mixed with water provided by either a remote low voltage pump or small gasoline pump 92 creating a slurry. An alternative source of gold bearing slurry can be introduced by means of a suction dredge arrangement as shown in FIG. 4, DWG 3/17. The slurry passes through a removable classifier 56, thereby removing larger waste rock and gravel which is discarded to the rear of upper tray 72. A variety of classifiers are to be made available, each with different size openings. The choice of the particular classifier is to be made by the prospector. Classifiers with larger openings will allow larger particles to enter the water/sand slurry 112. By chosing a classifier 56 which closely matches the size of the particles of gold to be processed the prospector can expect enhanced results. The slurry then falls upon a deflector pan or under chute 70 which carries it by means of gravity, and its liquid state, to the upper portion of the processing sluice or tray 98. The sluice area is composed of bi-fold trays 96 & 98 that hinge on each other whereby its overall length can be reduced for transportation and expanded for use. With this arrangement no sacrifice of recovery area is made. If the embodiment is used in conventional mode then a small low voltage pump or small gasoline powered pump 92 is placed in a water supply. This water supply may be a natural body of water or a containment vessel. With this in mind, this embodiment is small enough to be placed within a small storage container. The storage container can then be used as a recirculating water containment vessel as shown in FIG. 11 Dwg. 10/17. This ability is of great benefit to prospectors working in arid areas where a natural water source is not available. Water, either from a natural or artificial source, is pumped by means of a small flexible hose 86, to the spray piping arrangement located in the upper tray 72 portion of the embodiment. This spray piping system is constructed so that water under pressure, provided by the pump 92 is sprayed, through a plurality of holes, out across the sand and gravel placer materials thereby creating the aforementioned slurry. The waste material then slides off the lower end of the classifier 56 and is no longer a concern. After being diverted to the upper end of the lower sluice area the slurry then passes over the expanded metal section 38. This section consist of raised expanded metal which in cross section creates a plurality of small riffles. This expanded metal section is held in place by means of hold down 42. The purpose of a riffle is to create an area of low pressure into which gold particles, as well as, other heavy materials, mostly hematite and magnetite, commonly referred to as black sand, become trapped. Some heavier gemstones are also collected in the low pressure areas commonly referred to as eddies. Eddies are created when a protrusion is placed into a moving flow of water.

The aforementioned expanded metal section is placed on top of a final mat 40 consisting of any number of materials. The most common are indoor outdoor carpet, v-ribbed rubber matting or an extruded rubber fiber matting commonly referred to as "miners moss". The purpose of the final mat 40 is to provide additional riffles by means of a plurality of small groves which run perpendicular to the flow of the slurry. After leaving the expanded metal section 38 the slurry then passes over a riffle cage 36 consisting of a plurality of riffles which run perpendicular to the slurry flow. Again, the riffle cage 36 is installed on top of the final mat 40 and secured in place with riffle hold down clamps 64. Since the recovery rate of the embodiment is dependant on water flow the utilization of adjustable legs 68, leg extenders 74 and extender retaining pin 76 are provided. This allows for maximum adjustment of the water flow which must be carefully regulated for maximum recovery. Final recovery of the gold particles and black sand is accomplished by removing the final mat 40 and washing it in a separate water filled container. The sand and gold particles are then separated in a gold pan.

Removable accessories are stored inside the embodiment as shown in FIG. 17, DWG. 14/17. FIG. 13 DWG 14/17 shows the embodiment exploded and expanded to show method of storage of different components. Storage lid 90 is ready to receive legs 21, final mat 40, which has been folded, riffle cage 36, expanded metal section 38 and upper classifier 56. Pump 92 is positioned in the space between upper tray 72 and middle tray 96. This space is made available when Upper tray 72 is lowered onto middle tray 98. Storage lid 90 it is then placed into position on the embodiment. When this is accomplished, lower tray locks 48 engage latching tabs 114. Riffle hold down clamp 64 is also now available to be used to provide additional assistance in keeping storage lid 90 in position. When storage lid 90 is in position it also provides thereby closure panels for both open ends of lower tray 96, as well as, the one open end of middle tray 98. Spray pipe hose 86 is now coiled and positioned, inside the available space in the interior of upper tray 72. Storage lid 30 is then slid into position and the compaction of the embodiment is complete. Carry handle 88 is also shown being held in position by a single fastener on each side of the embodiment thereby providing a pivot point to allow movement of the handle, providing ease of handling.

CONCLUSION, RAMIFICATIONS, AND SCOPE

The reader will see that the embodiment of the present invention enables a gold prospector to transport, to the locations of the placer gold materials, a compact, fully functional tool for the separation of gold particles from waste sand and gravel.

The wide disparity between the specific gravity of gold at 19.3 and the specific gravity of the waste material at 2.0 creates the opportunity for rapid separation. The embodiment described herein excels at taking advantage of this disparity by means of riffles and other devices in this separation.

Since obvious changes may be made in the specific embodiment of the invention described herein, it is indicated that all matter contained herein is intended as illustrative and not limited in scope. For example the embodiment shown herein is constructed utilizing lightweight metal, i.e. aluminum. Other methods of construction are also possibilities, such as plastic and etc. Some of the attachments may be molded or welded onto the embodiment in lieu of using fasteners. The proportions of different components may be changed and methods of attachment may be altered. Thus the scope of the invention should be determined by the appended claims and their legal equivalents, rather than just by the examples given.

What we claim and desire to secure by Letters of Patent of the United States is:

1. A mining apparatus, reconfigurable between a first operational configuration and a second transport configuration, for recovery of heavy metals and minerals from wet or dry placer ore deposits the apparatus comprising:

an upper tray, comprising: a pair of opposing side walls, and a bottom, and a first end at the edge of the bottom between the sidewalls and a second end opposite the first end, the upper tray having a closed first end and an open second end;

an under chute protruding at an incline from the bottom of the upper tray, progressively extending further away from the bottom as the under chute approaches the second end of the upper tray;

the upper tray having a feed pipe for receiving pressurized water, the feed pipe proximate the first end, a pair of spray pipes running atop the upper tray inboard of and parallel to the sidewalls and configured to receive water from the feed pipe;

an upper classifier in the upper tray;

a middle tray having a first end and a second end, the middle tray comprising a pair of opposing side walls, and a bottom, and having an open second end;

a pair of upper tray pivot brackets extending upward from the side walls of the middle tray proximate the first end of the middle tray;

a carry handle extending between the upper tray pivot brackets; the carry handle pivotably attached to the upper tray pivot brackets;

a pivot hole near the upper end of the upper tray pivot brackets, and pivoting fasteners for attaching the upper tray to the upper tray pivot brackets through the holes in a pivotal manner, said pivoting fasteners pivotable to a first position with the upper tray positioned above the middle tray and the upper tray under chute positioned to drop passed sortant onto the middle tray and a second position for transport with the upper tray and the middle tray adjacent and parallel;

the middle tray sidewalls having an inner side and an outer side;

a leg clasp on the outer side of each middle tray sidewall, the leg clasps configured to receive a removable adjustable leg; a pair of adjustable legs each inserted in each of the middle tray leg clasps;

at least one brace attached to the side of the middle tray for supporting the upper tray at an incline relative the middle tray;

each adjustable leg of the middle tray having a leg extender and a leg extender pin for selectively locking the leg in length; each leg clasp having a leg locking screw for locking said leg in place;

a lower tray, having a first end and a second end comprising: a pair of opposing side walls, and a bottom, and having an open first end and an open second end;

the lower tray sidewalls having an inner side and an outer side;

a hinge for attaching the lower tray first end to the second end of the middle tray in a pivotal manner, wherein the hinge pivots the lower tray relative the middle tray to a first position for operation to place the lower tray and middle tray in a coplanar position, and a second position for transport wherein the middle tray and lower tray are folded onto one another with their respective bottoms adjacent;

a lock having a portion on the outside of the lower tray sidewall engaging a lock portion on the middle tray to hold the middle tray and lower tray in a coplanar position;

a pair of leg clasps on the outer side of the each lower tray sidewall, the lower tray leg clasps configured to receive a removable leg;

a pair of legs each inserted in each of the lower tray leg clasps;

a removable mat on top of the middle tray and lower tray;

a removable expanded metal section having a series of small riffles placed on top of a mat in the middle tray;

a removable riffle cage with a pair of opposing sidewalls and having a series of riffles running from sidewall to sidewall of the riffle cage said riffle cage arranged on top of the mat in the lower tray with the sidewalls of the riffle cage running parallel to and inboard of the lower tray sidewalls;

a first pump for pumping water from a water supply; and a spray feed hose for transporting water from the first pump to the feed pipe.

2. The apparatus of claim 1 wherein the upper classifier is removable.

3. The apparatus of claim 1 further comprising a dredge discharge hose configured to discharge material onto the upper tray via an upper tray dredge feed plate.

4. The apparatus of claim 3 further comprising:

a dredge suction nozzle connected to the dredge discharge hose;

said dredge suction nozzle with an opening for sucking material from a stream, and a first input for receiving high pressure water and a second input for sucking material from a placer source;

a second pump for supplying high pressure water to the dredge suction nozzle.

5. The apparatus of claim 4 further comprising: the dredge suction nozzle connected to second pump via a small high pressure hose;

the second pump having an input hose for receiving water from a water source with an input screen inside the input hose.

6. The apparatus of claim 1 further comprising:

the upper tray oriented on the upper tray pivot brackets to place the upper tray above a vertical projection of the middle tray.

7. The apparatus of claim 1 further comprising:

each brace is an adjustable sliding brace for varying the angle of incline of the upper tray; and each sliding brace having a locking handle for locking the upper tray angle of incline in place.

8. The apparatus of claim 1 further comprising: a middle tray end plate attached between the middle tray sidewalls and the middle tray bottom.

9. The apparatus of claim 1 further comprising:

an expanded metal section hold down tab for securing the expanded metal section to the middle tray;

a riffle cage hold down tab attached to the sidewalls of the riffle cage; and a riffle cage hold down clamp for securing the riffle cage to the lower tray.

10. The apparatus of claim 1, wherein the first pump is a low voltage pump.

11. The apparatus of claim 1, wherein the first pump is a gasoline pump.

12. The apparatus of claim 1 further comprising:

a removable storage lid for covering the opening on the second end of the lower tray during transport; and latching tabs attached to the lid for engaging with the lower tray lock.

13. The apparatus of claim 12 further comprising: a pair of retaining rails at the side of the storage lid for preventing lateral movement of the closure lid relative the lower tray, the storage lid having a retaining lip for preventing vertical movement of the closure lid relative the middle tray and lower tray.

14. The apparatus of claim 1 further comprising: a set of shoulder straps attached to the bottom of the lower tray.

* * * * *

UNITED STATES PATENT AND TRADEMARK OFFICE

CERTIFICATE OF CORRECTION

PATENT NO. : 9,132,431 B2
APPLICATION NO. : 12/657265
DATED : September 15, 2015
INVENTOR(S) : Alderson et al.

It is certified that error appears in the above-identified patent and that said Letters Patent is hereby corrected as shown below:

The title page showing the illustrative figure should be deleted to be replaced with the attached title page.

Signed and Sealed this
Fifth Day of July, 2016

Michelle K. Lee

Michelle K. Lee
*Director of the United States Patent and Trademark Office*

(12) United States Patent
Alderson et al.

(10) Patent No.: US 9,132,431 B2
(45) Date of Patent: Sep. 15, 2015

(54) EQUIPMENT FOR USE IN THE EXTRACTION OF PLACER GOLD FROM GRAVEL AND SAND DEPOSITS

(75) Inventors: Larry Allen Alderson, Robards, KY (US); Peggy I. Alderson, Robards, KY (US)

(73) Assignee: Larry Allen Alderson, Robards, KY (US)

( * ) Notice: Subject to any disclaimer, the term of this patent is extended or adjusted under 35 U.S.C. 154(b) by 494 days.

(21) Appl. No.: 12/657,265

(22) Filed: Jan. 15, 2010

(65) Prior Publication Data

US 2010/0193406 A1 Aug. 5, 2010

Related U.S. Application Data

(60) Provisional application No. 61/206,728, filed on Feb. 4, 2009.

(51) Int. Cl.
*B03B 7/00* (2006.01)
*B03B 5/26* (2006.01)
*B03B 9/00* (2006.01)

(52) U.S. Cl.
CPC .... *B03B 5/26* (2013.01); *B03B 9/00* (2013.01)

(58) Field of Classification Search
USPC ..... 209/44
IPC ..... B03B 5/26,9/00
See application file for complete search history.

(56) References Cited

U.S. PATENT DOCUMENTS 801,968 A * 10/1905 Clark ..... 209/44
883,861 A * 4/1908 Creasey ..... 209/44
1,240,396 A * 9/1917 Winchester ..... 209/43
1,473,039 A * 11/1923 Harkins ..... 209/440
1,510,742 A * 10/1924 Gutleben ..... 209/420
1,915,602 A * 6/1933 Goody ..... 209/273
1,973,770 A * 9/1934 McCullough ..... 209/14
2,101,295 A * 12/1937 Rusk ..... 209/466
2,174,925 A * 10/1939 McKeever ..... 209/44
2,261,574 A * 11/1941 Thompson ..... 209/202
2,358,409 A * 9/1944 Martin ..... 209/451

(Continued)

*Primary Examiner* — Stefanos Karmis
*Assistant Examiner* — Michael E Butler

(57) ABSTRACT

A portable device for the separation of gold from other materials commonly found in placer deposits of gravel, sand, etc. Including an upper tray (72) into which is located a water spray assembly and placer materials classifier. This upper tray to be hinged to middle sluice tray (98), which has located on its bottom panel an expanded metal section (38) on top of a final mat (40) consisting of ribbed rubber matting or other suitable material, which has a series of groves, to be used as washable riffling device. Lower sluice tray (96) to be attached by hinging device to middle sluice tray (98) and locked into place by lower tray locks (48). Lower sluice tray to have laying on its bottom panel a continuation of final mat (40). This mat to be held in place by a riffle cage (36) containing a series of rigid riffles. Riffle cage (36) to be secured by hold down clamps (64). Expanded metal to be held in place by tab (42). Upper tray to be supported by sliding brace (43) and locking handles (94). Device to be supported by legs (68) and extenders (74). Water to be supplied by small pump to device through flexible hose connected to feed pipe (78). When not in use the device to be folded and compactable into small portable unit with storage of legs, mat, riffle cage and other removable accessories inside embodiment and secured by means of storage lids (30) and (90). Lid (90) to be secured by means of locks (48) and tabs (114). Device to be carried by handle (88).

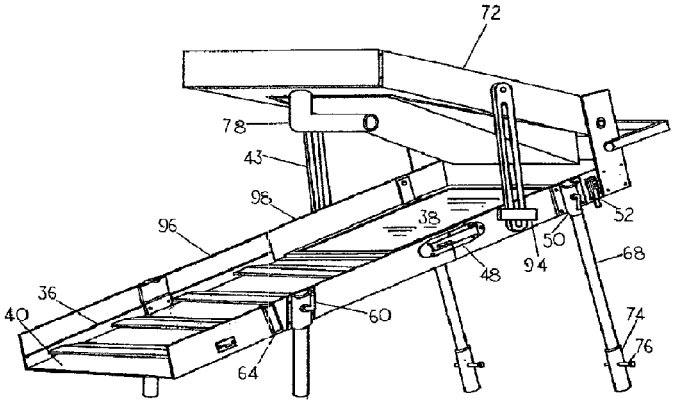

14 Claims, 17 Drawing Sheets